US005123583A

United States Patent [19]

Kato et al.

[11] Patent Number: 5,123,583

[45] Date of Patent: Jun. 23, 1992

[54] PAPER FEEDER FOR PRINTERS

[75] Inventors: Hiroyuki Kato, Nagoya; Toshiki Morita, Toyoake; Teruo Deshimaru, Nagoya, all of Japan

[73] Assignee: Brother Kogyo Kabushiki Kaisha, Nagoya, Japan

[21] Appl. No.: 570,265

[22] Filed: Aug. 20, 1990

[30] Foreign Application Priority Data

Aug. 21, 1989 [JP] Japan ..... 1-214438

[51] Int. Cl.[5] ..... B65H 20/20

[52] U.S. Cl. ..... 226/74; 226/110; 400/616.1; 400/618; 192/48.6

[58] Field of Search ..... 226/74, 75, 108, 109, 226/110, 101; 400/616.1, 616.2, 618; 192/48.6, 48.92

[56] References Cited

U.S. PATENT DOCUMENTS 3,618,719 11/1971 Marland et al. ..... 192/48.6 X
3,955,737 5/1976 Traise ..... 226/108
4,345,708 8/1982 Hubbard ..... 226/74
4,458,796 4/1984 Nitanda et al. ..... 192/48.92 X
4,825,988 5/1989 Nishimura ..... 792/48.92 X

FOREIGN PATENT DOCUMENTS 0074856 4/1988 Japan ..... 226/188
90/01416 8/1988 PCT Int'l Appl. .

*Primary Examiner*—Daniel P. Stodola
*Assistant Examiner*—P. Bowen
*Attorney, Agent, or Firm*—Jones, Tullar & Cooper

[57] ABSTRACT

A paper feeder for printers having front and back pin tractor assemblies disposed on opposite sides of a platen roller with respect to the paper feed route. Each tractor has a plurality of pins which are rotatable so as to convey the continuous paper. A reversible drive source is coupled to both the pin tractors. A clutch selectively decouples the drive source from the front pin tractors in accordance with the rotational direction of the drive source. A switch mechanism independent of the clutch also selectively decouples the front pin tractor from the drive source. The described structure allows paper stack to be automatically removed from between the tractors.

12 Claims, 6 Drawing Sheets

FIG. 6
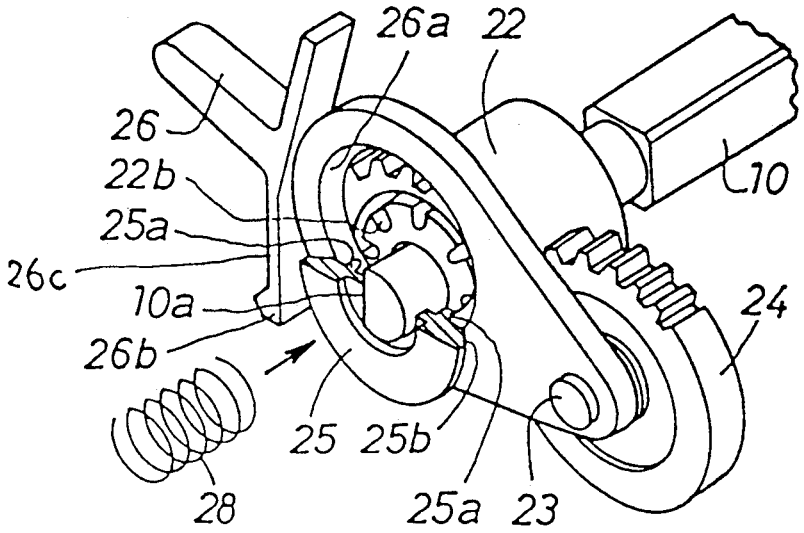
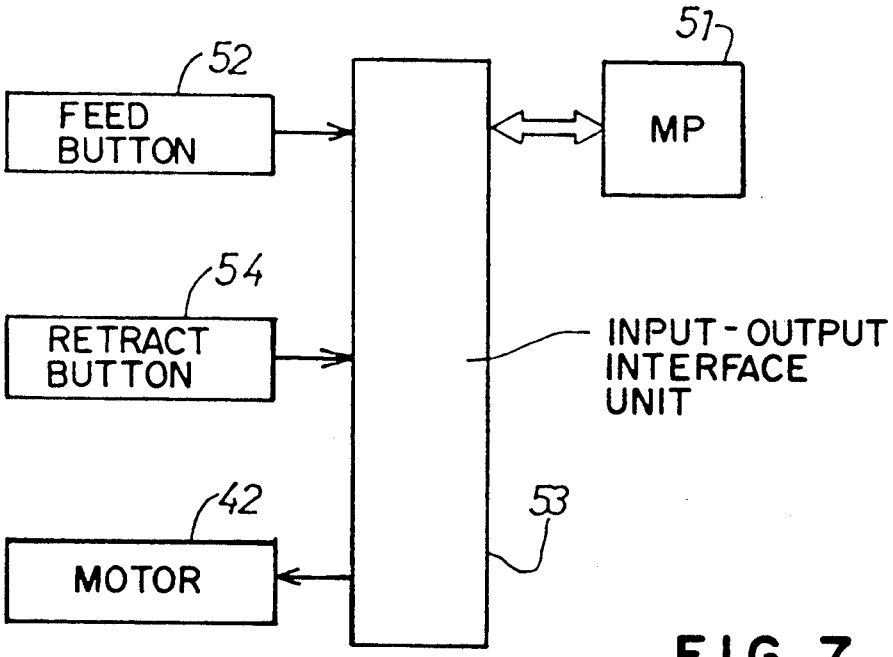
FIG. 7

PAPER FEEDER FOR PRINTERS

BACKGROUND OF THE INVENTION

1. Field of the Invention

The present invention relates generally to printers and, more particularly, to an improved printer paper feeder for feeding continuous paper.

2. Description of the Related Art

Printers which have continuous paper feeders are generally known. A typical such feeder has a pair of front and a pair of back pin tractors disposed on a paper feeding route. A platen roller is positioned therebetween. Each tractor has a plurality of rotatable pins. The pins are arranged to engage with holes formed on both side ends of a continuous paper. Thus, the rotating motion of the pins will feed the continuous paper.

In order to set the continuous paper in the above feeder, the tip of the paper is first set at the back pin tractors. Then, the back pin tractors are rotated to feed the paper tip to the front pin tractors via the platen roller so as to position the tip at the front pin tractors. However, when the paper is tensed to be set in the front pin tractors, the holes at the paper rarely geometrically correspond to the pin positions of the front pin tractors. Thus, the paper usually has a looseness between the front and back tractors when it is set. Accordingly, users have to manually adjust the front pin tractors' position to remove any slack in the paper.

However, such manual adjustments are troublesome. Therefore, feeders which automatically remove the looseness of the continuous paper have been proposed.

In such feeders, the continuous paper also has a looseness between the front and back pin tractors at setting. After such setting is finished, the pins of the back pin tractors rotate in reverse. At this time, a mechanism such as a one-way spring clutch or the like cuts off the drive transfer to the front pin tractors. Accordingly, the back pin tractors pull the paper backward while the front pin tractors remain stationary and thus remove the looseness of the paper between the front and back pin tractors.

In the aforementioned feeder, the continuous paper may also be set from the bottom of the printer or the like without passing through the back pin tractors. In this case, a paper feed is performed only by the front pin tractors. If the paper is fed only frontward, there is no problem. However, it may occasionally be necessary to feed the paper a relatively large distance backward, such as when enlarged letters or the like are to be printed. In such cases, the one-way spring clutch or the like prevents the front pin tractors from rotating in reverse and thereby prevent the retraction of the continuous paper.

SUMMARY OF THE INVENTION

Accordingly, it is a primary objective of the present invention to provide a paper feeder for printers which automatically removes the looseness of the continuous paper and also is capable of feeding and retracting the paper even when the front pin tractors are used alone.

To achieve the foregoing and other objects and in accordance with the purpose of the present invention, an improved paper feeder for printers is provided. The paper feeder is adapted to feed continuous paper to a platen roller disposed in a paper feed path. The feeder has two pairs of pin tractor assemblies which are located on opposite sides of the platen roller with respect to the paper feed path. The tractors each have a plurality of pins which are rotatable to convey the paper. The pins engage with holes on the continuous paper. A reversible drive means powers the rotation of the pins via a drive mechanism. A clutch mechanism selectively decouples the front pin tractor assembly from the drive means depending upon the rotational direction of the drive means. Moreover, a switching mechanism is provided between the drive mechanism and the front pin tractors. The switching mechanism selectively decouples the front pin tractors from the drive means independent of the clutch mechanism.

In accordance with a second aspect of the invention, a controller is provided for removing slack from between the tractor assemblies. The controller first rotates the tractors in a forward direction. The back pin tractors are then rotated in the reverse direction to pull the paper backward. Thus, the looseness, between the front and back pin tractors, of the continuous paper is removed.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments together with the accompanying drawings in which:

FIG. 6 is a perspective view showing a switch lever and the like of the front pin tractors.

FIG. 7 is a block diagram showing a control circuit for the paper feeder.

DETAILED DESCRIPTION OF THE PREFERRED EMBODIMENTS

Figure 1:
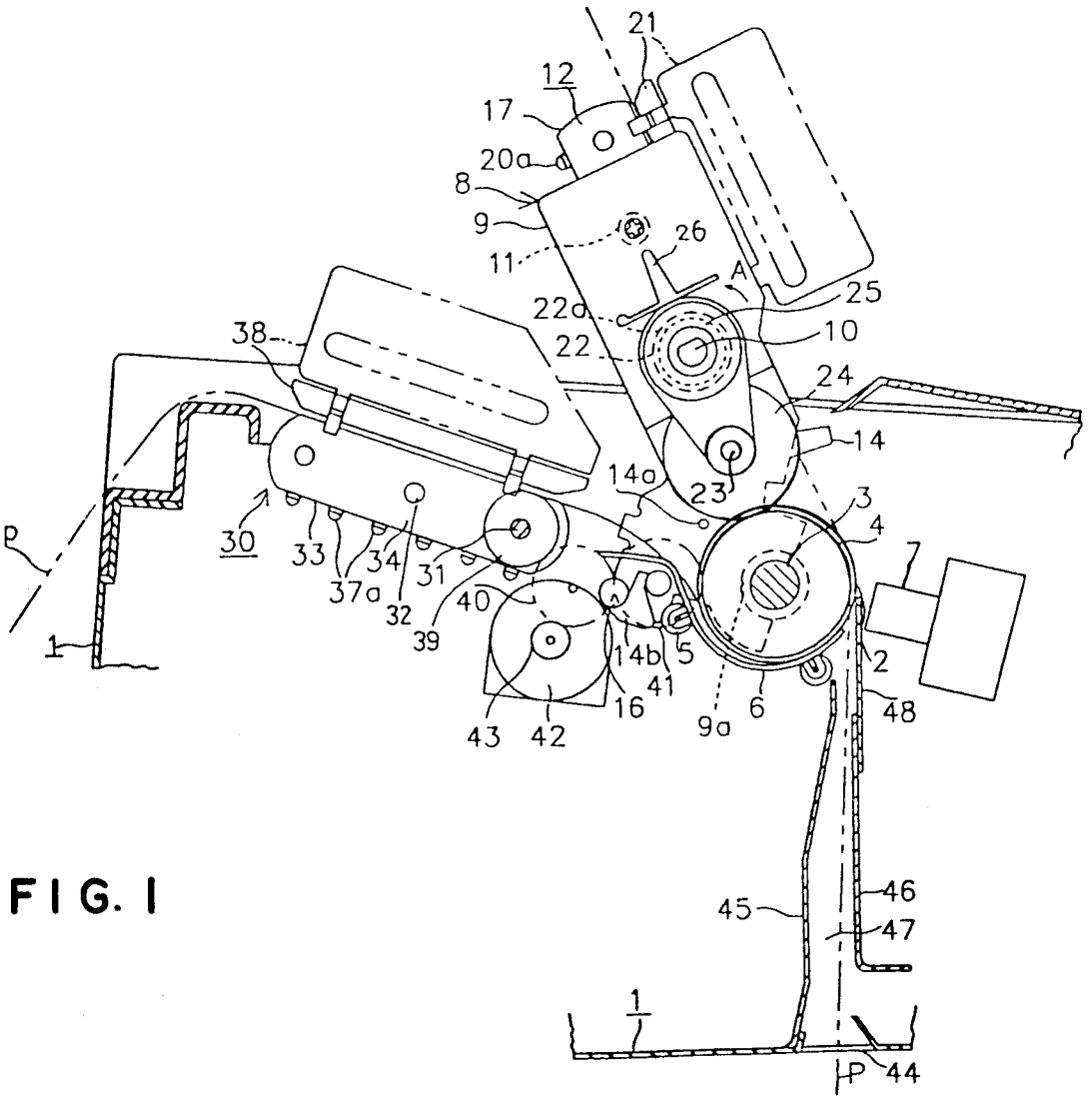
FIG. 1 is a partially broken sectional side view showing one embodiment of a printer paper feeder in accordance with the present invention.

As illustrated in the drawings, a preferred embodiment of the present invention will be described in detail hereinafer.

As shown in FIG. 1, a platen roller 2 is supported on a printer case 1 by means of a platen shaft 3. The platen roller 2 is located on a running route of a continuous paper P and extends along the width direction of the paper P. A platen gear 4 is fixed to one end of the platen shaft 3. A paper guiding plate 6 is provided below the platen roller 2 and supports a plurality of paper holding rollers 5. A printing head 7 is provided before the platen roller 2 and reciprocates back and forth along the roller 2.

Figure 2:
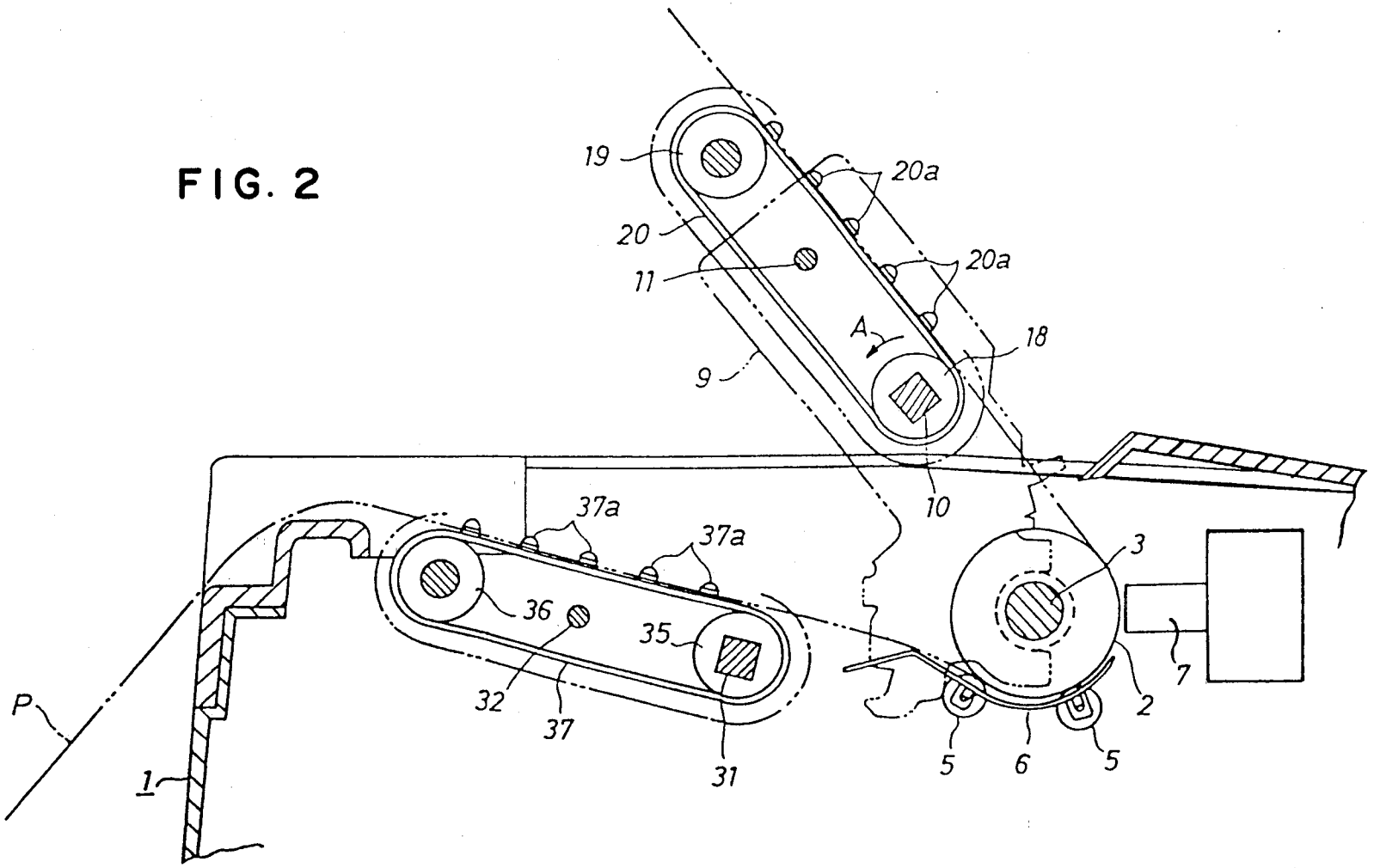
FIG. 2 is a simplified sectional side view showing the paper feeder including two pairs of pin tractors.
Figure 3:
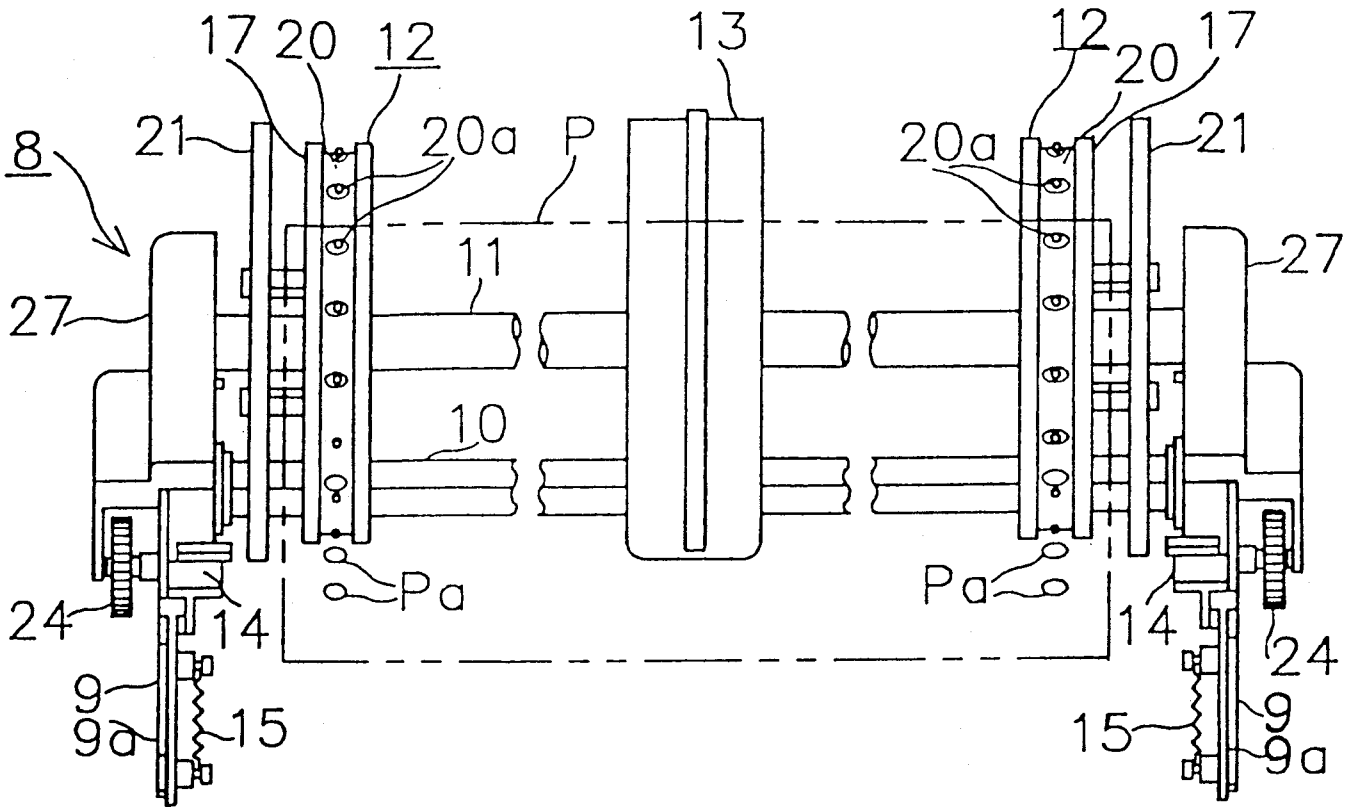
FIG. 3 is a sectional view showing front pin tractors without a guide plate.

A front tractor unit 8 is disposed in front, on the running route of the paper P, of the platen roller 2. As shown in FIGS. 1 to 3, the tractor unit 8 has a pair of detachable side plates 9 which are assembled on opposite ends of the platen shaft 3. A square drive shaft 10 and connecting shaft 11 are provided between the side plates 9 and extend in parallel with the platen roller 2. A pair of front pin tractors 12 are supported on both the shafts 10 and 11 and may move thereon in the width direction of the paper P for adjustment. A supporting plate 13 is also supported on both the shafts 10 and 11 between the pin tractors 12.

Figure 4:
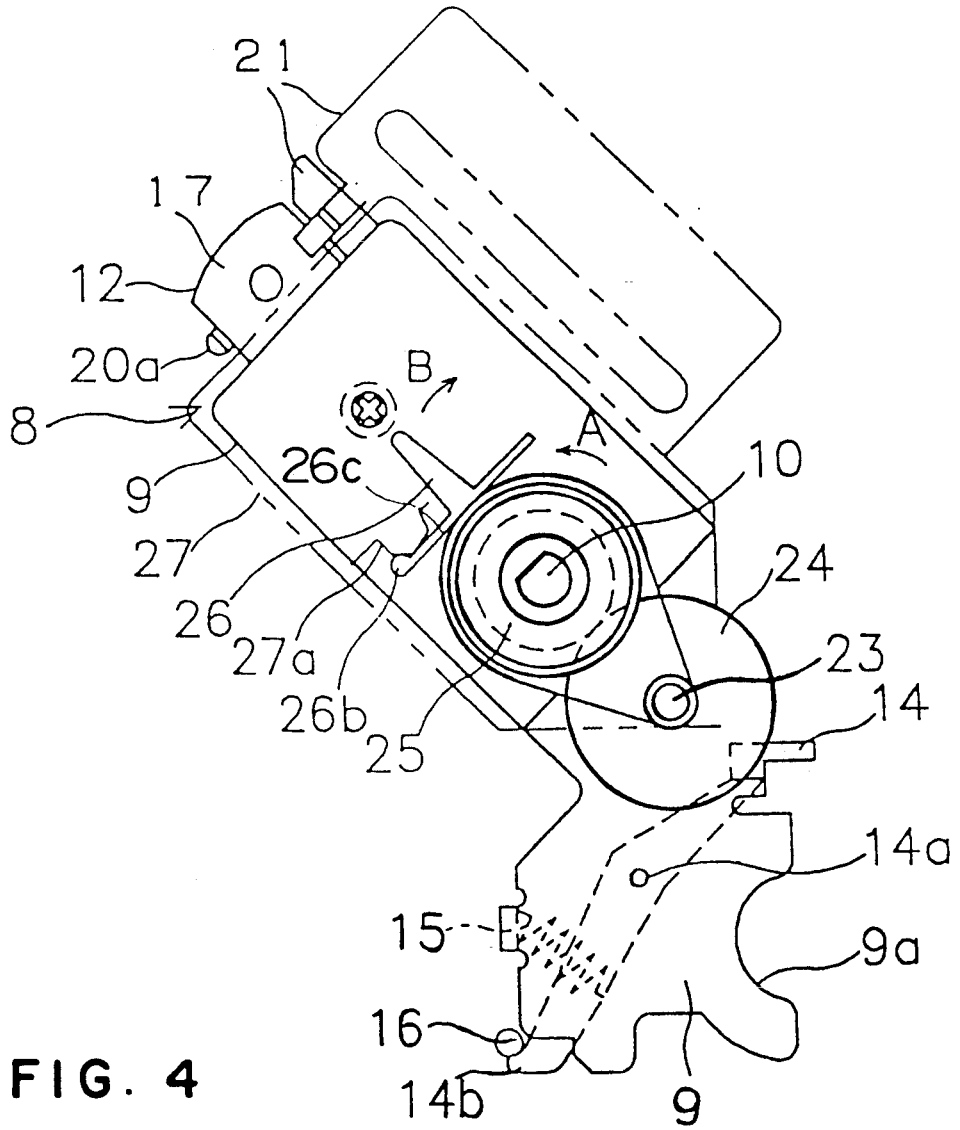
FIG. 4 is a partial side view showing the front pin tractors.

As shown in FIGS. 1 and 4, the side plates 9 each have a recess 9a which is to be fitted to each end of the platen shaft 3 so as to attach the unit 8 to an upper portion of the printer. The side plates 9 each support a release lever 14 at an inner side thereof by means of a pivot 14a, about which the levers 14 are rotatable. A tension spring 15 is hooked at each lever 14 and urges the levers 14 so as to engage hook portions 14b (the lower portions of the levers 14) with engaging pins 16 of the printer case 1 when the front tractor unit 8 is assembled to the printer case 1. When the unit 8 is disassembled from the printer, the release levers 14 are rotated against the force of the tension spring 15 to detach the hook portions 14b from the engaging pins 16.

As shown in FIGS. 1 to 3, the front pin tractors 12 have a tractor frame 17. The tractor frame 17 supports a pair of follower pulleys 19 and a pair of drive pulleys 18 which rotate together with the drive shaft 10. A pin belt 20 having a plurality of pins 20a is hooked between the pulleys 18 and 19 respectively. The pins 20a are spaced to engage holes Pa in the continuous paper P. When the pins 20a rotate, they engage the holes Pa as shown in FIG. 3, thereby conveying the continuous paper P. The tractor frame 17 also has a guide plate 21 which is switched between two positions. One is a lying position shown as solid lines in FIGS. 1 and 4. The other is a standing position shown as two dot chain lines in FIGS. 1 and 4. The paper P may be placed on or removed from the tractors when the guide plate is in the standing position. The paper is held at the lying position.

Figure 5:
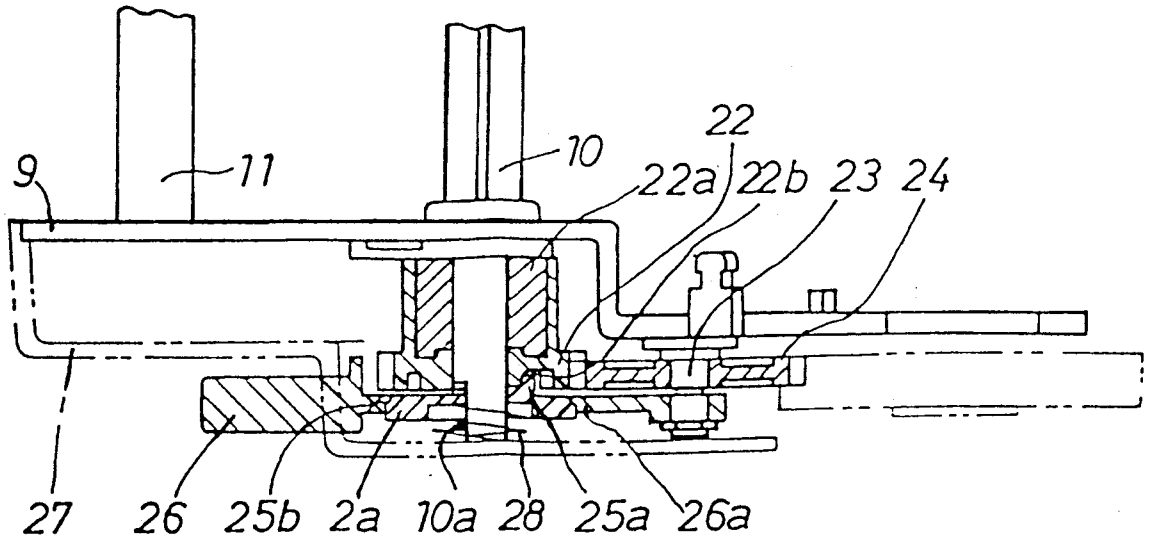
FIG. 5 is a partially broken sectional plan view showing a tractor gear and the like of the front pin tractors.

As shown in FIG. 5, a tractor gear 22 is disposed at one end of the drive shaft 10 outside the side plate 9 and has a one-way spring clutch 22a. The one way spring clutch 22a only transfers the forward rotation (in the direction of arrow A shown in FIGS. 2 and 4) of the gear 22 to the drive shaft 10 and does not transfer the backward rotation. An axle 23 is provided standing on the side plate 9 adjacent the tractor gear 22 and supports an intermediate gear 24 which is rotatable about the axle 23. The intermediate gear 24 connects the tractor gear 22 and the platen gear 4 together.

The end of the drive shaft 10 projecting from the gear 22 is cut off to form a flat surface 10a. A beveled clutch plate 25 is fitted to the flat surface 10a and is movable along the axial direction of the shaft 10. The clutch plate 25 rotates together with the drive shaft 10.

A single or a plurality of engaging projections 25a are provided on a surface, adjacent the tractor gear 22, of the clutch plate 25 and project toward the gear 22. By way of example, eight engaging projections 25a are coaxially arranged at equal intervals in this embodiment (only a part thereof is shown in FIGS. 5 and 6). The clutch plate 25 is beveled and has a tapered portion 25b at the periphery thereof. The tapered portion 25b converges toward the gear 22.

Eight engaging recesses 22b corresponding to the engaging projections 25a are formed on a surface, adjacent the clutch plate 25, of the tractor gear 22 coaxially at equal intervals (only a part thereof is shown in FIGS. 5 and 6).

A switch lever 26 is supported on the axle 23, about which the lever 26 swings. The switch lever 26 has an opening 26a which is tapered. The tapered opening 26a converges toward the gear 22. The clutch plate 25 is to be inserted into the opening 26a. When the clutch plate 25 is inserted into the opening 26a, a predetermined space is defined between the tapered portion 25b and the opening 26a. The switch lever 26 also has an elastic arm 26c which has a nib 26b at a tip thereof.

As shown in FIGS. 3 and 5, the gears 22 and 24 and both ends of each shaft 10 and 11 are covered with covers 27 which are attached to the side plates 9 from outside. One of the covers 27 adjacent the tractor gear 22 has a catch 27a (refer to FIG. 4). A part of the switch lever 26 is located outside the cover 27 and the catch 27a is to be engaged with the nib 26b. When the nib 26b is engaged with the catch 27a, the switch lever 26 is held at a position shown in FIG. 4. And when the switch lever 26 is swung in the direction of arrow B in FIG. 4, the elastic arm 26c is elastically deformed. Thus, the nib 26b goes over the catch 27a and is positioned at the opposing side of the catch 27a.

A spring 28 is disposed between the cover 27 and the clutch plate 25 and always urges the clutch plate 25 toward the tractor gear 22. When the center of the opening 26a overlaps the center of the drive shaft 10 as the switch lever 26 swings, the spring 28 brings the clutch plate 25 into the opening 26a. Then, the engaging projections 25a are engaged with the engaging recesses 22b. The tractor gear 22, the clutch plate 25, the switch lever 26, and the spring 28 compose a switching mechanism.

As shown in FIGS. 1 and 2, a back tractor unit 30 is disposed behind the platen roller 2 relative to the running route of the paper P. The back tractor unit 30 extends in parallel with the platen roller 2 and has a guide shaft 32 and a drive shaft 31 which is supported and rotatable on the printer case 1. A pair of back pin tractors 33 are disposed on both the shafts 31 and 32 and are movable in the width direction of the continuous paper P for adjustment.

The back pin tractors 33 are designed similar to the front pin tractors 12. A pair of drive pulleys 35 are supported on a tractor frame 34 via the drive shaft 31 and a pair of follower pulleys 36 are also supported on the frame 34. A pin belt 37 having a plurality of pins 37a is strung between the pulleys 35 and 36 respectively. A guide plate 38 which may be shifted between standing and lying positions is disposed on the tractor frame 34.

As shown in FIG. 1, a tractor gear 39 is fixed to one end of the drive shaft 31 outside one of the back pin tractors 33. The tractor gear 39 is connected to the platen gear 4 via intermediate gears 40 and 41 which are supported by and rotatable with respect to the printer case 1. The intermediate gear 40 is also connected to a motor gear 43 of a motor 42, which works as a drive source and may rotate both ways.

In this embodiment, the gears 4, 22, 24, and 39 through 41 compose a drive mechanism which transfers a drive force of the motor 42 to both the front and back pin tractors 12 and 33.

The printer case 1 has a paper feed 44 at the bottom thereof. A pair of guide plates 45 and 46 are disposed adjacent the paper feed and form a chute, namely a paper pathway 47. The continuous paper P may be inserted through the paper pathway 47 without passing through the back pin tractors 33. The guide plate 46 has a fin 48, which elastically press the paper P against the platen roller 2, at an end thereof adjacent and along the platen roller 2.

A control circuit for the foregoing paper feeder will be explained hereinafter in accordance with FIG. 7.

This feeder has a microprocessor (which will be referred to as MP hereinafter) 51 which works as the control circuit of the motor 42. The MP 51 stores a control program for the motor 42. A feed button 52 outputs a feed signal to the MP 51 via an input-output interface unit 53 to rotate the motor 42 in the forward direction. A retract button 54 outputs a retract signal to the MP 51 via the interface unit 53 to rotate the motor 42 backward. The MP 51 outputs a control signal to the motor 42 via the input-output interface unit 53 in accordance with the signals from the buttons 52 and 54.

The method for feeding a continuous paper P by means of both the front and back pin tractors 12 and 33 will be explained next.

In order to feed the paper P by using both the tractors 12 and 33, the switch lever 26 should be moved in the direction arrow B. As the nib **26*b* passes over the catch 27*a*. almost a half of the inner surface of the opening 26*a* comes into contact with a corresponding half of the periphery of the tapered portion 25*b*. As the switch lever 26 is moved further in the direction of the arrow B, the half periphery of the tapered portion 25*b* slides on the tapered inner surface of the opening 26*a*. Thus, the clutch plate 25 is pushed outward along the drive shaft 10 against the urging force of the spring 28, and the engaging projections 25*a* are separated from the engaging recesses 22*b*. Accordingly, the clutch plate 25 is separated from the tractor gear 22. At this point, the switch lever 26 has past beyond the catch 27*a* and is held at the opposing side of the catch 27*a***.

Then, a paper P is set at the back pin tractors 33 so that holes Pa at the tip of the paper P are engaged with the pins **37*a*. The feed button 52 is depressed to input a feed signal into the MP 51. In accordance with the inputted signal, the MP 51 drives the motor 42** forward to feed the continuous paper P in a predetermined distance.

The drive force of the motor 42 is transferred via the gears 4, 22, 24, and 39 through 41 and the one-way spring clutch **22*a* to the front and back pin tractors 12 and 33. Thus, the pins 20*a* and 37*a* rotate forward to feed the paper P. The tip of the paper P is thus fed from the back pin tractors 33 to the front pin tractors 12 via the platen roller 2 and the paper holding roller 5**.

After the paper P is sufficiently fed so that the tip of the paper P may be set at the front pin tractors 12, the tip holes Pa are engaged with the pins **20*a* of the front pin tractors 12. In order to completely overlap the holes Pa and the pins 20*a*, the continuous paper P usually requires a little looseness between both the front and back pin tractors 12 and 33** for setting.

When the retract button 54 is depressed, the MP 51 first rotates the motor 42 frontward to feed the paper P for a predetermined distance. The forward feeding here insures that the paper P is securely hooked on the front pin tractors. Thus, the paper P will not accidentally fall off from the front pin tractors 12 when retracted in the next step.

Then, the MP 51 rotates the motor 42 backward to retract the paper P for a predetermined distance. The drive force is transferred to the back pin tractors 33 via the gears 43, 40, and 39. However, a retract drive transfer to the front pin tractors 12 is cut off by means of the one-way spring clutch **22*a* and also because of the separation of the clutch plate 25 from the tractor gear 22. Therefore, only the back pin tractors 33 rotates backward to retract the paper P a predetermined distance. The retract distance is determined so that the continuous paper P does not fall off from the front pin tractors 12 and that the tractors 12** rotate backward slightly by means of the retract force given by the paper P itself. Accordingly, the retract distance is a little larger than the preceding feed distance. Thus, the paper P is given a tension and its looseness is automatically removed.

After the looseness of the paper P is thus removed, the MP 51 again rotates the motor 42 forward a predetermined distance and then stops the motor 42 to wait for a printing operation. Accordingly, backlashes of the gears 4, 22, 24, and 39 through 41 are eliminated, and a firm engagement between the holes Pa and the pins **20*a* and 37*a*** is obtained.

Therefore, in the present embodiment, it is unnecessary to move and adjust the front tractor unit 8 manually so as to remove the looseness of the paper P, which has been required in a prior art embodiment, and the looseness may be easily and effectively removed upon a simple operation of the retract button 54. Moreover, subsequent paper feeding will be smoothly performed since the drive force from the motor 42 always provides a constant tension to the paper P.

The method for feeding a paper P by means of only the front pin tractors 12 will be explained hereinafter.

In order to feed the paper P by the tractors 12 alone, the switch lever 26 has to be moved in the opposite direction to the arrow B. Thus, the nib **26*b* passes over the catch 27*a* and the switch lever 26 is shifted from a position shown in FIG. 6 to a position shown in FIG. 4. In this position, the center of the opening 26*a* overlaps the center of the drive shaft 10. Thus, the clutch plate 25 is brought into the opening 26*a* toward the tractor gear 22 by means of the urging force of the spring 28. If the engaging projections and recesses 25*a* and 22*b* overlap one another, they come to be engaged. Even if the projections and recesses 25*a* and 22*b* do not overlap one another at this point, they will overlap and come to be engaged when the motor 42 rotates the tractor gear 22 in the following step. Therefore, the forward and backward rotations of the tractor gear 22 are transferred to the drive shaft 10 via the clutch plate 25**.

Continuous paper P is inserted from the paper feed 44 through the paper pathway 47 and then goes through the platen roller 2 to the front pin tractors 12. The paper P is set at the tractors 12 by engaging the holes Pa at the tip of the paper P with the pins **20*a*. As the paper P is set in this way, the rolled angle of the paper P on the platen roller 2 becomes more moderate than when the paper P is set through both the tractors 12 and 33**. Thus, even if the paper P fed into the printer has several laminated sheets, the various sheets will not be shifted with respect to one another. It will be appreciated that this is particularly useful when printing on forms or the like having multiple sheets of carbon paper.

Once the paper is set, the MP 51 rotates the motor 42 to feed the paper P for a predetermined distance in accordance with printing data. The drive force from the motor 42 is transferred to the tractor gear 22 via the gears 40, 41, 4, and 24 and the one-way spring clutch **22*a* and via the clutch plate 25. Thus, the front pin tractors 12** rotate frontward to feed the paper P.

At times, the MP 51 may rotate the motor 42 backward in order to retract the continuous paper P a predetermined distance. For example, the paper P occasionally has to be retracted for the purpose of printing enlarged letters or the like thereon. In the retraction mode, the drive force from the motor 42 is transferred to the tractor gear 22 via the gears 40, 41, 4, and 24 and the clutch plate 25 to rotate the front pin tractors 12 backward. Accordingly, the paper P is retracted. At this time, the back pin tractors 33 also rotate but idly.

The front pin tractors 12 thus may rotate backward because the clutch plate 25 is connected to the drive shaft 10 according to the operation of the switch lever 26. Therefore, the paper P may be inserted into the printer through the paper pathway 47 without passing through the back pin tractors 33 and may be both fed and retracted by means of only the front pin tractors 12. Thus, enlarged letters or the like may be printed without having misplacements of the laminated pieces of the paper P using only the front pin tractors 12.

Although only one embodiment of the present invention has been described herein, it should be apparent to those skilled in the art that the present invention may be embodied in many other specific forms without departing from the spirit or scope of the invention. Particularly, it should be understood that following modes are contemplated as well.

An electromagnetic clutch may replace the foregoing one-way spring clutch 22*a* as the clutching mechanism so as to allow or prevent the rotation of the drive shaft 10.

A one-way clutch including a ratchet pawl may replace the clutch plate 25 so that the drive shaft 10 can rotate both ways when the ratchet pawl is in engagement.

In the foregoing embodiment, the front tractor unit 8 is detachable, but it can be integrally assembled in the printer together with the back tractor unit 30.

Therefore, the present examples and embodiments are to be considered as illustrative and not restrictive and the invention is not to be limited to the details given herein, but may be modified within the scope of the appended claims.

We claim:

1. A paper feeder for supplying continuous paper to a printer having a platen roller disposed in a paper feed path, the continuous paper having a series of holes along at least one edge, the feeder comprising:

first and second pin tractor assemblies disposed on opposite sides of the platen roller with respect to the paper feed path, said first and second tractor assemblies each having a plurality of pins adapted to engage the paper holes, the pins being rotatably driven in a first paper feeding mode to convey the continuous paper;

reversible drive means for powering rotations of the pins;

clutch means for selectively decoupling the second pin tractor assembly from the drive means dependant upon the rotational direction of the drive means when the paper feeder is in said first paper feeding mode; and switching means independent of the clutch means for selectively connecting the second pin tractor assembly to the drive means so that the second pin tractor can be driven independent of the clutch means to provide a second paper feeding mode wherein the continuous paper is conveyed independent of the first pin tractor assembly.

2. A paper feeder as set forth in claim 1 wherein said clutch means includes a one-way spring clutch.

3. A paper feeder as set forth in claim 2 further comprising a drive mechanism for coupling the drive means to the second pin tractor assembly, the drive mechanism including a tractor gear and wherein:

said second tractor assembly includes a shaft; and said one-way spring clutch is carried by the shaft.

4. A paper feeder as set forth in claim 3 wherein said switching means includes:

a clutch plate mechanically coupled to the second pin tractor assembly and arranged for selective engagement with the tractor gear; and a switch lever for selectively engaging and disengaging the clutch plate from the tractor gear.

5. A paper feeder as set forth in claim 4 further comprising a spring for urging the clutch plate toward the tractor gear, the clutch plate being separated from the tractor gear against the urging force of the spring in accordance with operations of the switch lever.

6. A paper feeder as set forth in claim 4 further comprising a projection and a recess formed on facing surfaces of the tractor gear and the clutch plate, said projection and recess being arranged such that when engaged, the tractor gear and clutch plate rotate integrally.

7. A paper feeder as set forth in claim 1 further comprising an alternate paper pathway through which the continuous paper may be feed to the platen roller without passing through the first pin tractor assembly when the paper feeder is in the second paper feeding mode.

8. A paper feeder as set forth in claim 7 wherein said clutch means includes a one-way spring clutch.

9. A paper feeder as set forth in claim 7 further comprising a drive mechanism for coupling the drive means to the second pin tractor assembly, the drive mechanism including a tractor gear and wherein said switching means includes:

a clutch plate mechanically coupled to the second pin tractor assembly and arranged for selective engagement with the tractor gear; and a switch lever for selectively engaging and disengaging the clutch plate from the tractor gear.

10. A paper feeder as set forth in claim 9 further comprising:

a spring for urging the clutch plate toward the tractor gear, the clutch plate being separated from the tractor against the urging force of the spring in accordance with operations of the switch lever; and a projection and a recess formed on facing surfaces of the tractor gear and the clutch plate, said projection and recess being arranged such that when engaged, the tractor gear and clutch plate rotate integrally.

11. A paper feeder for supplying continuous paper to a printer having a platen roller disposed in a paper feed path, the continuous paper having a series of holes along at least one edge, the feeder comprising:

first and second pin tractor assemblies disposed on opposite sides of the platen roller with respect to the paper feed path, said first and second tractor assemblies each having a plurality of pins adapted to engage the paper holes, the pins being rotatably driven in a first paper feeding mode to convey the continuous paper;

reversible drive means for powering rotations of the pins;

clutch means for selectively decoupling the second pin tractor assembly from the drive means dependent upon the rotational direction of the drive means when the paper feeder is in said first paper feeding mode;

switching means independent of the clutch means for selectively connecting the second pin tractor assembly to the drive means so that the second pin tractor can be driven independent of the clutch means to provide a second paper feeding mode wherein the continuous paper is conveyed independent of the first pin tractor assembly;

an alternate paper pathway for use in the second paper feeding mode, through which the continuous paper may be feed to the platen roller without passing through the first pin tractor assembly; and control means for removing paper slack between the first and second tractor assemblies when the continuous paper is originally feed into the printer in the first paper feeding mode, said control means being arranged to rotate the drive means in a forward direction so as to rotate the tractor assemblies to feed the paper in a forward direction and then reversing the drive means to rotate the first pin tractor assembly in a reverse direction to remove paper slack, the second pin tractor assembly being decoupled from the drive means by said clutch means when said drive means is rotated in the reverse direction.

12. A paper feeder as set forth in claim 11 wherein said clutch means includes a one-way spring clutch.

* * * * *